US009599114B2

(12) United States Patent
Chen

(10) Patent No.: US 9,599,114 B2
(45) Date of Patent: Mar. 21, 2017

(54) MODULAR CROSS FLOW FAN AND AIR CONDITIONING DEVICE

(71) Applicant: JIN YIH SHYANG ENTERPRISE CO., LTD., Taoyuan County (TW)

(72) Inventor: Chang-Cheng Chen, Taoyuan County (TW)

(73) Assignee: JIN YIH SHYANG ENTERPRISE CO., LTD., Taoyuan County (TW)

( * ) Notice: Subject to any disclaimer, the term of this patent is extended or adjusted under 35 U.S.C. 154(b) by 314 days.

(21) Appl. No.: 14/460,621

(22) Filed: Aug. 15, 2014

(65) Prior Publication Data

US 2015/0275899 A1 Oct. 1, 2015

(30) Foreign Application Priority Data

Mar. 28, 2014 (TW) ..... 103205405 U

(51) Int. Cl.

| | |
|---|---|
| ***F24H 3/06*** | (2006.01) |
| ***F28F 13/12*** | (2006.01) |
| ***F04D 17/04*** | (2006.01) |
| ***F04D 29/42*** | (2006.01) |

(52) U.S. Cl.

CPC ..... *F04D 17/04* (2013.01); *F04D 29/4226* (2013.01); *F28F 13/12* (2013.01)

(58) Field of Classification Search

CPC ..... F04D 17/04; F04D 29/4226; F28F 13/12; F24H 3/02; F24H 3/04; F24H 3/0405; F24H 3/0411; F24D 13/00; F24D 15/00

USPC ..... 165/122, 120, 121; 415/53.1, 53.2, 53.3

See application file for complete search history.

(56) References Cited

U.S. PATENT DOCUMENTS 3,280,902 A * 10/1966 Laing ..... F04D 17/04 165/122
3,940,215 A * 2/1976 Hori ..... F04D 17/04 415/143
5,373,894 A * 12/1994 Tomatsuri ..... F24F 1/0007 165/122
5,388,426 A * 2/1995 Wada ..... F24F 1/0007 165/122
5,547,018 A * 8/1996 Takahashi ..... F24F 1/0011 165/122
5,669,229 A * 9/1997 Ohbayashi ..... F24F 1/0007 165/122
5,673,747 A * 10/1997 Kousaka ..... B60H 1/00207 165/122

(Continued)

*Primary Examiner* — Justin Jonaitis
(74) *Attorney, Agent, or Firm* — Li & Cai Intellectual Property (USA) Office

(57) ABSTRACT

A modular cross flow fan comprises a housing, a cross flow fan and a motor. The housing has an upper wall, a lower wall and two side boards. The housing is formed with an accommodating space, an inflow opening and an outflow opening. The direction of inflow and the direction of outflow lie in a line. The cross flow fan is disposed in the accommodating space. The motor is disposed at the housing and connected to the cross flow fan. Furthermore, an air conditioning device is provided, comprising modular cross flow fan, a flow channel and a heat exchanger. The flow channel is joined to the inflow opening. The heat exchanger is disposed in the flow channel proximal to the inflow opening. Ambient air can flow horizontally through the flow channel, the inflow opening, and into the housing.

7 Claims, 8 Drawing Sheets

(56) References Cited

U.S. PATENT DOCUMENTS

| | | | | |
|---|---|---|---|---|
| 5,918,666 | A * | 7/1999 | Chin | F24F 1/0007 165/121 |
| 6,345,951 | B1 * | 2/2002 | Choi | F04D 29/666 415/1 |
| 2004/0109753 | A1 * | 6/2004 | Lin | F04D 17/04 415/53.1 |
| 2006/0233638 | A1 * | 10/2006 | Chen | F04D 29/668 415/53.1 |

* cited by examiner

MODULAR CROSS FLOW FAN AND AIR CONDITIONING DEVICE

BACKGROUND OF THE INVENTION

1. Field of the Invention

The present disclosure relates to a cross flow fan; in particular, to a modular cross flow fan for driving airflow and an air conditioning device.

2. Description of Related Art

Referring to FIG. 8, a conventional cross flow fan 100 can be installed on appropriate locations on buildings for driving airflow, such that the hot air produced by heating device or the cold air produced by cooling device can be output for heating or cooling the building. A conventional cross flow fan 100 has an inflow opening 200 and an outflow opening 300 which are substantially perpendicular, or have an included angle of 60 and 135 degrees therebetween. However, the directions of the inflow and outflow which are substantially perpendicular or different by 60 to 135 degrees limit the height or thickness of the installation, and is therefore inconvenient.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a modular cross flow fan and an air conditioning device, whose directions of inflow and outflow are the same and lie in a line, for coping with installation and usage requirements of different venues.

In order to achieve the aforementioned objects, the present disclosure provides a modular cross flow fan, comprising: a housing having an upper wall, a lower wall and two side boards, wherein the upper wall, the lower wall and the two side boards define an accommodating space therebetween, the housing is formed with an inflow opening and an outflow opening and the direction of the inflow at the inflow opening and the direction of the outflow at the outflow opening lie substantially on the same line; a cross flow fan disposed in the accommodating space; and a motor disposed at the housing and connected to the cross flow fan.

The present disclosure further provides an air conditioning device comprising: a modular cross flow fan having a housing, a cross flow fan and a motor, wherein the upper wall, the lower wall and the two side boards define an accommodating space therebetween, the housing is formed with an inflow opening and an outflow opening and the direction of the inflow at the inflow opening and the direction of the outflow at the outflow opening lie substantially on the same line, the cross flow fan is disposed in the accommodating space, and the motor is disposed at the housing and connected to the cross flow fan; a flow channel joined to the inflow opening of the modular flow fan; and a heat exchanger disposed proximal to the inflow opening of the modular cross flow fan.

The present disclosure has the following effects. The inflow of the inflow opening and the outflow of the outflow opening of the modular cross flow fan according to the present disclosure substantially lie on the same line, for coping with installation and usage requirements of different venues. The air conditioning device of the present disclosure has a flow channel joined to the inflow opening, thereby the external air can enter the housing through the flow channel and the inflow opening in a laminar flow, for coping with different installation requirements of different venues.

In order to further the understanding regarding the present disclosure, the following embodiments are provided along with illustrations to facilitate the understanding of the present disclosure.

DETAILED DESCRIPTION OF THE PREFERRED EMBODIMENTS

First Embodiment

Figure 1:
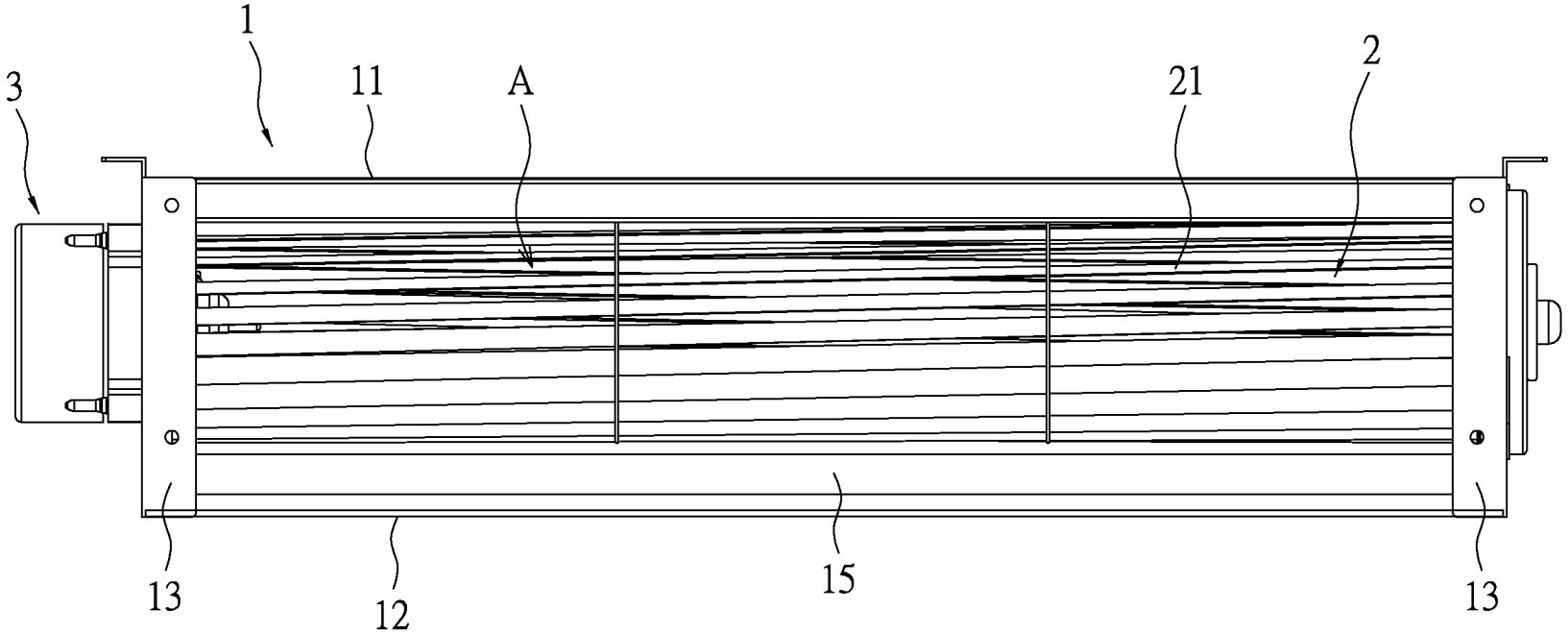
FIG. 1 shows a front view of a modular cross flow fan according to a first embodiment of the present disclosure.
Figure 2:
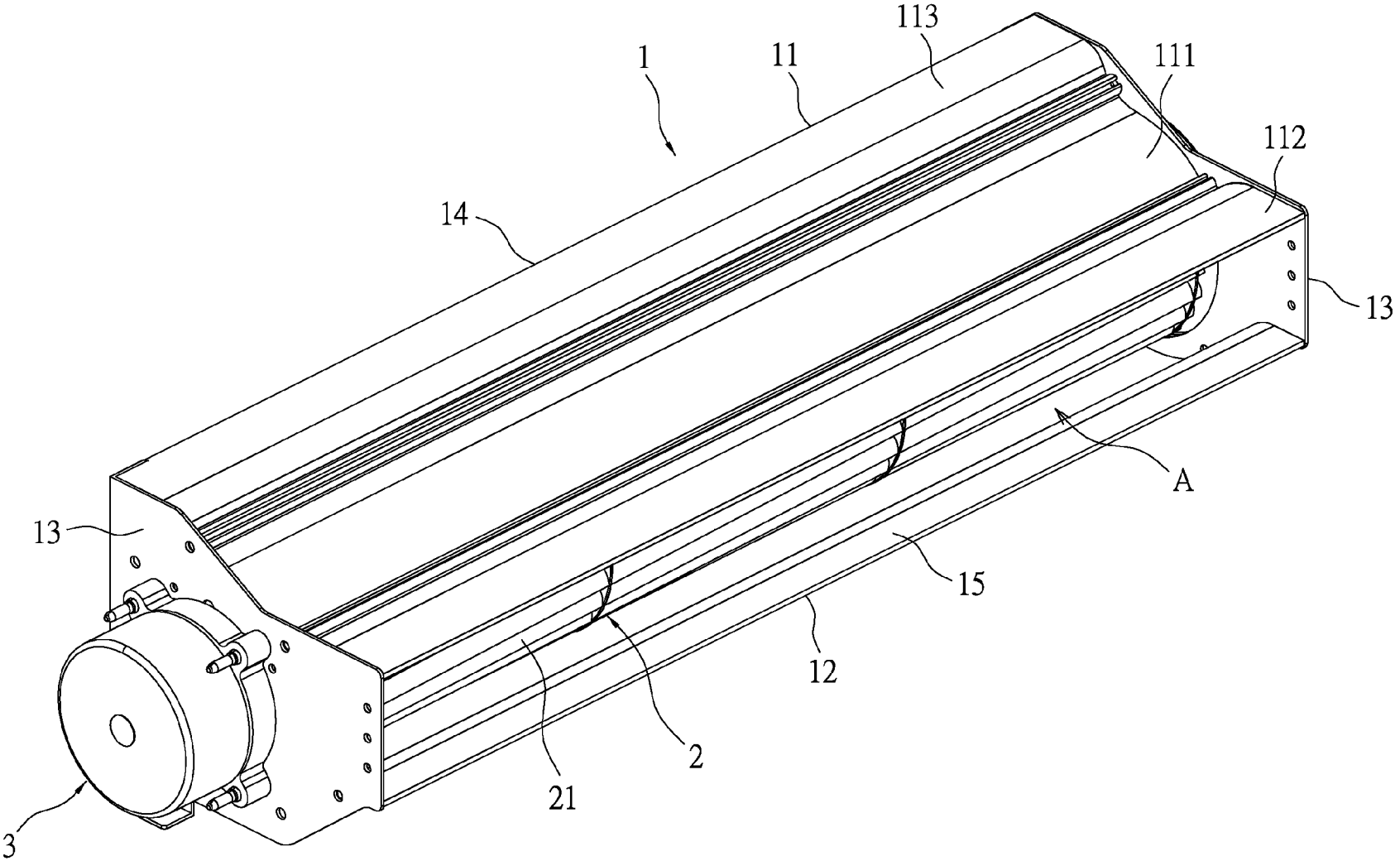
FIG. 2 shows a perspective view of a modular cross flow fan according to a first embodiment of the present disclosure.
Figure 3:
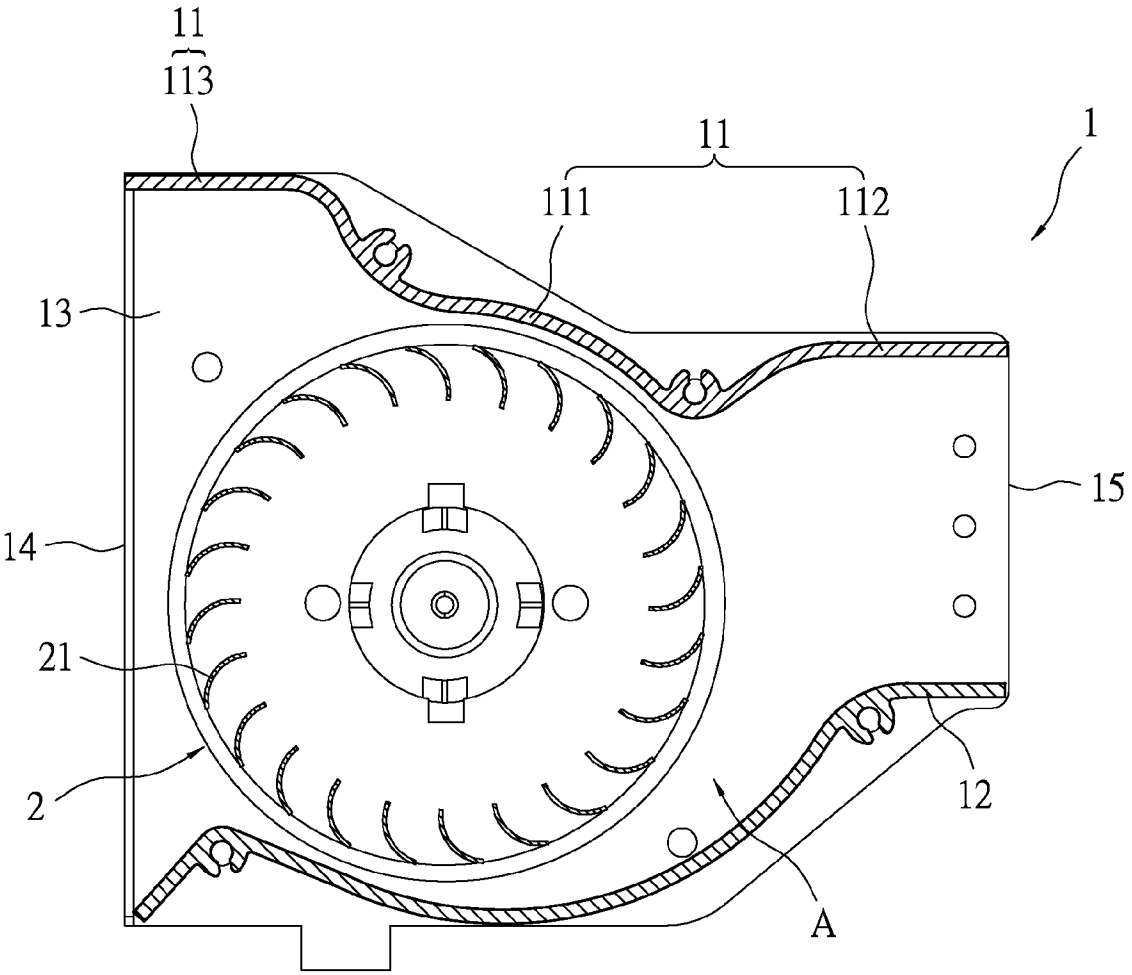
FIG. 3 shows a cross-sectional view of a modular cross flow fan according to a first embodiment of the present disclosure.

Referring to FIG. 1 to FIG. 3, the present disclosure provides a modular cross flow fan comprising a housing 1, a cross flow fan 2 and a motor 3.

The housing 1 is elongated. The length of the housing 1 is not limited, and can be adjusted according to the quantity of corresponding cross flow fans 2. For example, when housing two or three cross flow fans 2, the housing 1 is formed with different lengths accordingly. In the present embodiment, the quantity of the cross flow fan 2 is one.

The housing 1 has an upper wall 1, a lower wall 12 and two side boards 13. The two side boards 13 are disposed at two opposite ends of the housing 1, namely the two ends in the length-wise direction of the housing 1. Preferably, the two side boards 13 are parallel. The upper wall 11 and the lower wall 12 are arranged between the two side boards 13. The upper wall 11 is connected to the top ends of the two side boards 13. The lower wall 12 is connected to the lower ends of the two side boards 13. The upper ends of the two side boards 13 and the lower ends of the two side boards 13 have shapes corresponding respectively to the cross-sectional shapes of the upper wall 11 and the lower wall 12. The method of connection between the upper wall 11 and the lower wall 12 can be latch, screw or a combination thereof, and adjusted according to need. The upper wall 11, the lower wall 12 and the two side boards 13 define an accommodating space A therebetween for accommodating a cross flow fan or other devices. The housing 1 is formed with an inflow opening 14 and an outflow opening 15. The inflow opening 14 and the outflow opening 15 are respectively formed on two opposite sides of the housing 1.

The upper wall 11 has a first board body 111, a second board body 112 and a third board body 113. The upper wall 11 can be integrally formed as one piece or formed by assembly. The first board body 111 is connected between the second board body 112 and the third board body 113. The second board body 112 is proximal to the side with the outflow opening 15. The third board 113 is proximal to the side with the inflow opening 14. The second board body 112 and the third board body 113 can be horizontal. Namely, the direction of inflow at the inflow opening 14 and the direction of outflow at the outflow opening 15 are horizontal. Additionally, the first board body 111 is slanted. The height of the first board body 111 decreases in the direction from the inflow opening 14 to the outflow opening 15. Through the horizontal arrangement of the second board body 112 and the third board body 113, the inflow direction of the inflow opening 14 and the outflow direction of the outflow opening 15 can be linear and horizontal with 180 degrees therebetween.

The cross flow fan 2 can be made of plastic and aluminum. The cross flow fan 2 has a plurality of blades 21 arranged at intervals in the shape of a cylinder. Two or three cross flow fans 2 can be disposed. In the present embodiment one cross flow fan 2 is disposed. The cross flow fan 2 is disposed in the accommodating space and can rotate. However, the structure and method of the pivotal connection of the cross flow fan 2 to the interior of the housing is conventional technique and not particular to the present disclosure, and is therefore not further described.

The motor 3 can be disposed in the housing 1. Two or three motors 3 can be disposed. In the present embodiment one motor 3 is disposed at one of the two side boards 13. The motor 3 can be fixed to the housing by screws or other methods. The motor 3 is connected to the cross flow fan 2, such that the cross flow fan 2 can be driven to rotate by the motor 3. The motor 3 can be a brushless DC motor or a stepper motor, having a small volume and low weight. However, the form of the motor 3 is not limited and can be of other types. The motor 3 is electrically connected to the appropriate control circuit (not shown in the figures).

Second Embodiment

Figure 4:
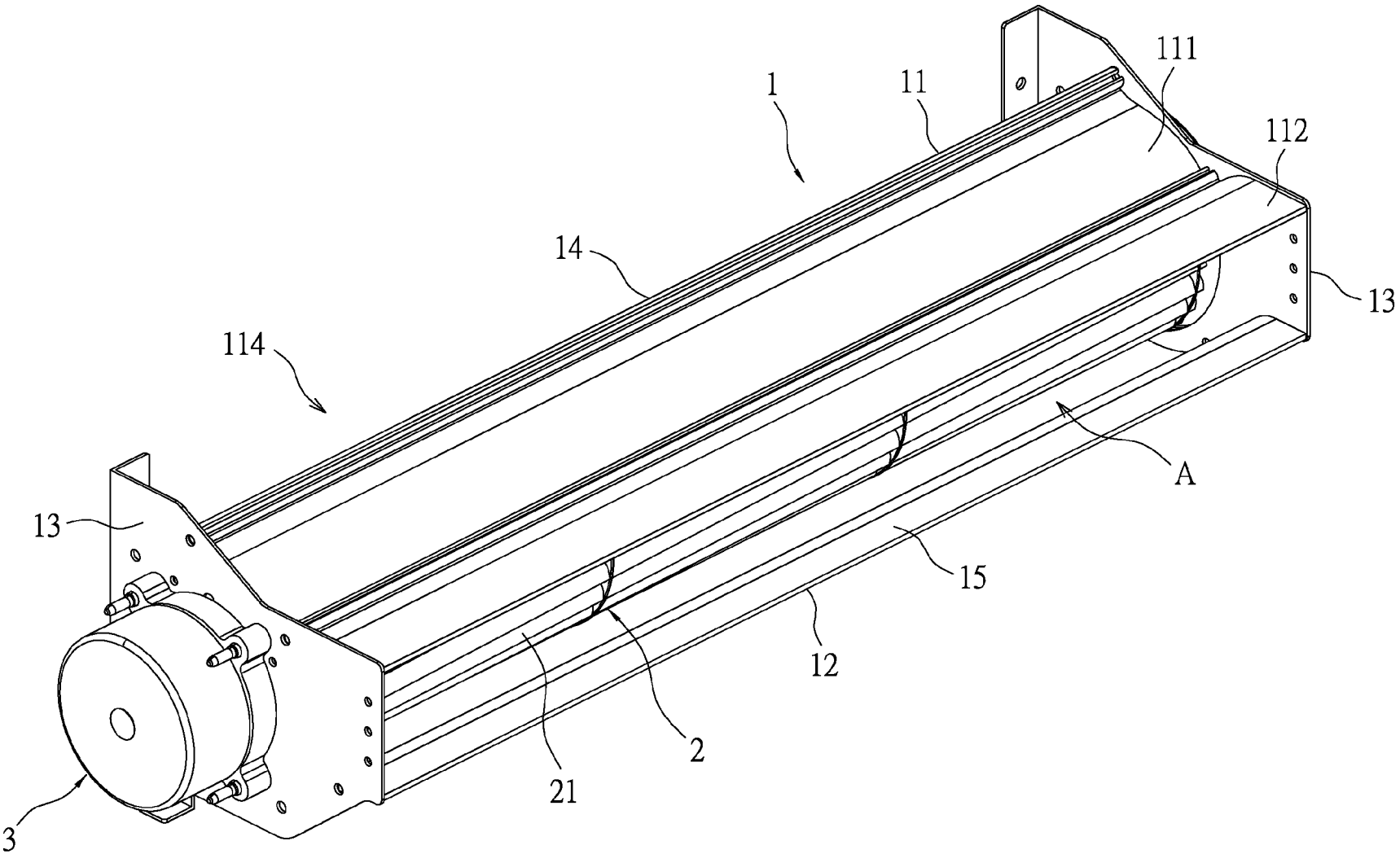
FIG. 4 shows a perspective view of modular cross flow fan according to a second embodiment of the present disclosure.

Referring to FIG. 4, the difference between the present embodiment and the first embodiment lies in that the upper wall 11 has a first board body 111, a second board body 112 and a first opening 114. The first board body 111 is arranged between the second board body 112 and the first opening 114. The first board body 111 is connected to the second board body 112. The first opening 114 is proximal to the side with the inflow opening 14. The second board body 112 is proximal to the side with the outflow opening 15. The first board body 111 is slanted. The height of the first board body 111 decreases in the direction from the inflow opening 14 to the outflow opening 15. Through the horizontal arrangement of the second board body 112, the outflow direction of the outflow opening 15 can be linear and horizontal. Through the arrangement of the first opening 114, the modular cross flow fan of the present disclosure can cope with installation requirements of different venues.

Third Embodiment

Figure 5:
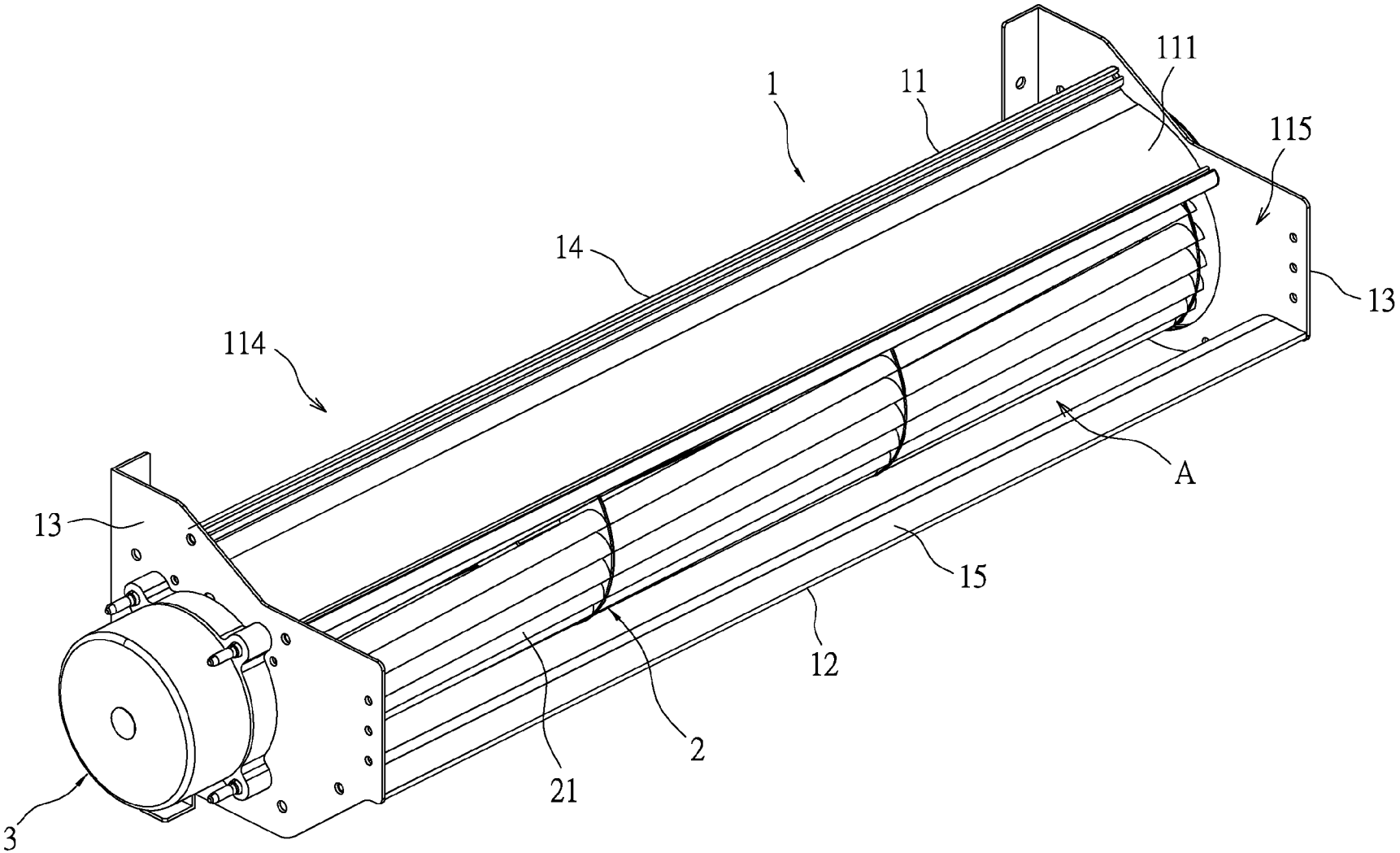
FIG. 5 shows a perspective view of modular cross flow fan according to a third embodiment of the present disclosure.

Referring to FIG. 5, the difference between the present embodiment and the first embodiment lies in that the upper wall 11 has a first board body 111, a first opening 114, and a second opening 115. The first board body 111 is arranged between the first opening 114 and the second opening 115. The first opening 114 is proximal to the side with the inflow opening 14. The second opening 115 is proximal to the side with the outflow opening 15. The first board body 111 is slanted. The height of the first board body 111 decreases in the direction from the inflow opening 14 to the outflow opening 15.

Fourth Embodiment

Figure 6:
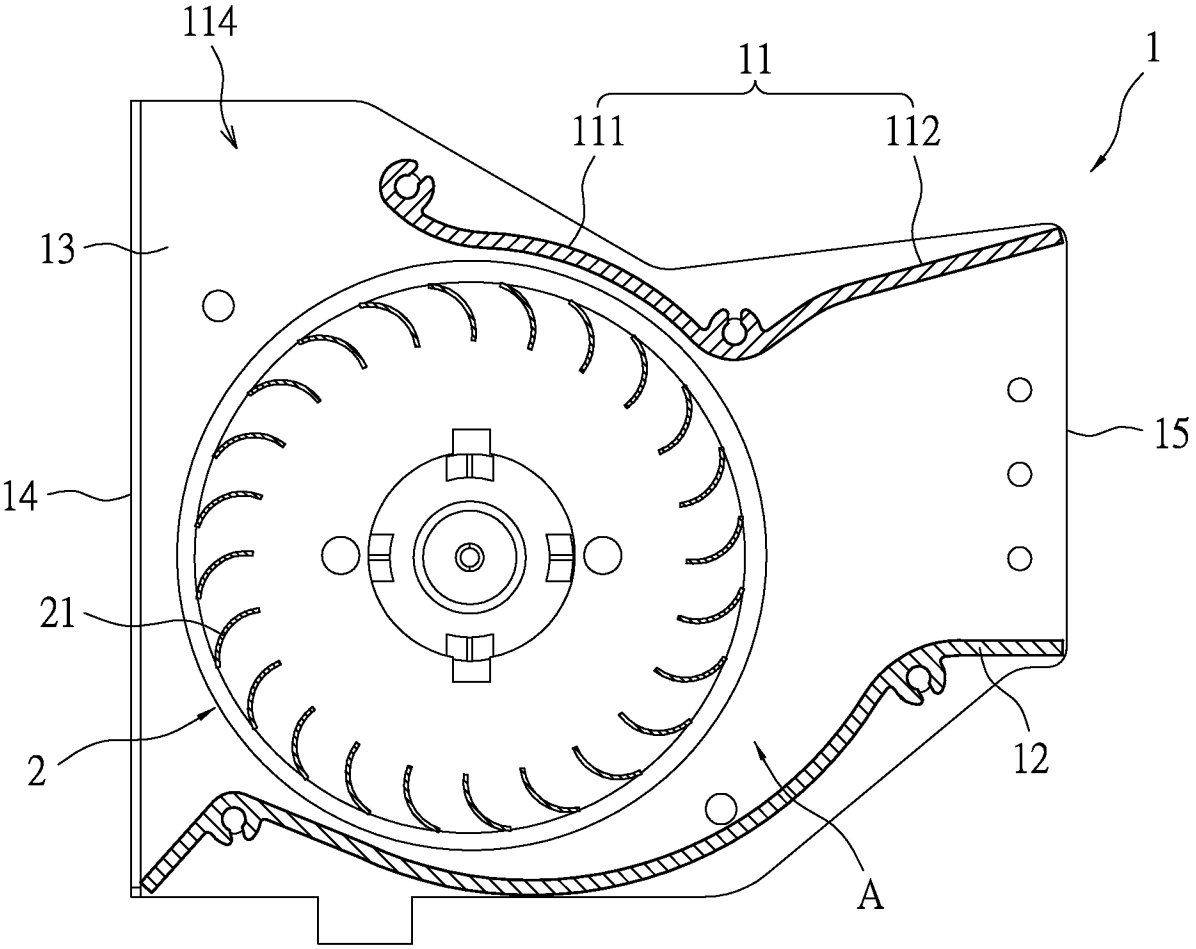
FIG. 6 shows a cross-sectional view of a modular cross flow fan according to a fourth embodiment of the present disclosure.

Referring to FIG. 6, the difference between the present embodiment and the first embodiment lies in that the upper wall 11 has a first board body 111, a second board body 112, and a first opening 114. The first board body 111 is arranged between the second board body 112 and the first opening 114. The first board body 111 is connected to the second board body 112. The first opening 114 is proximal to the side with the inflow opening 14. The second board body 112 is proximal to the side with the outflow opening 15. The first board body 111 and the second board body 112 are slanted. The height of the first board body 111 decreases in the direction from the inflow opening 14 to the outflow opening 15. The height of the second board body 112 increases in the direction from the inflow opening 14 to the outflow opening 15. Additionally, through the slanted arrangement of the second board body 112, the outflow direction of the outflow opening 15 can output from the housing 1 at an inclined angle.

Fifth Embodiment

Figure 7:
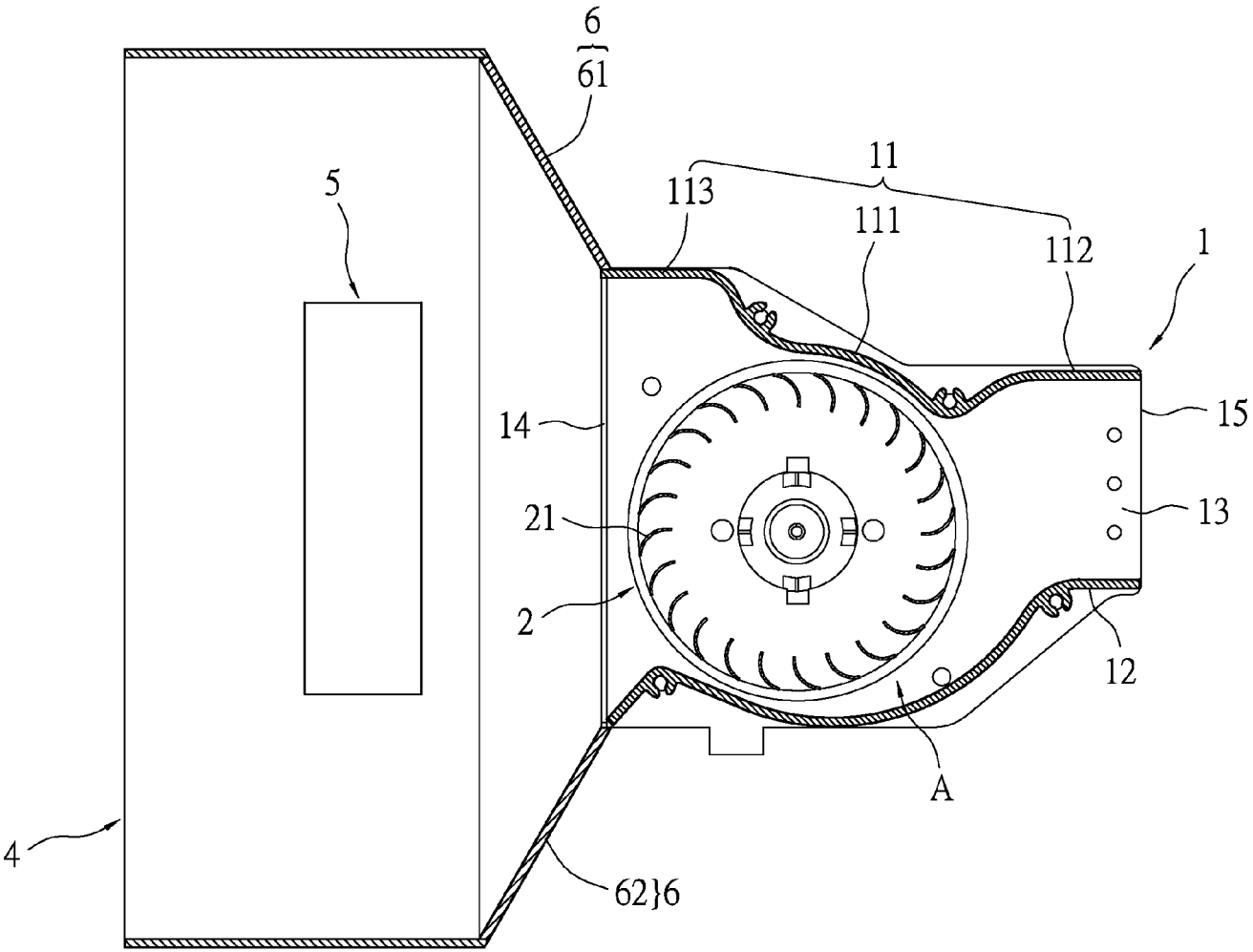
FIG. 7 shows a cross-sectional view of a modular cross flow fan and an air conditioning device according to the present disclosure.
Figure 8:
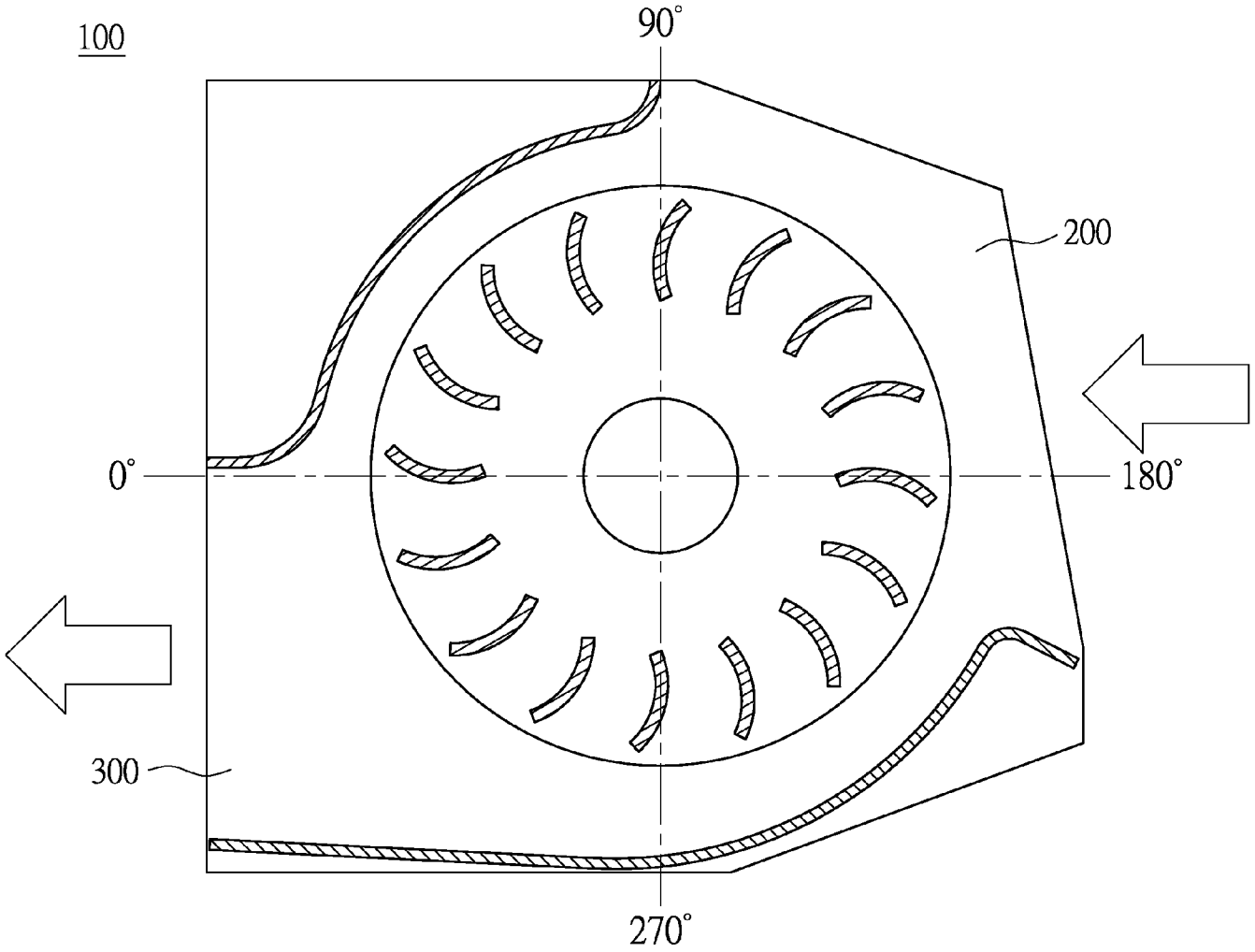
FIG. 8 shows a cross sectional view of a conventional cross flow fan.

Referring to FIG. 7, the present disclosure provides an air conditioning device comprising a modular cross flow fan, a flow channel 4 and a heat exchanger 5. The modular cross flow fan comprises a housing 1, a cross flow fan 2 and a motor 3, whose structures are described in the above embodiments and are not further detailed herein.

A partition board 6 can be arranged between the housing 1 and the flow channel 4. The partition board 6 can be made of plastic and aluminum. The partition board 6 has an upper partition board 61 and a lower partition board 62. In the present embodiment, the upper partition board 61 and the lower partition board 62 are slanted, the upper partition board 61 is connected to the flow channel 4 and the side of the third board body 113 proximal to the inflow opening 14, and the lower partition board 61 is connected to the flow channel 4 and the side of the lower wall 12 proximal to the inflow opening 14. The method of connecting the partition board 6 to the flow channel 4, the upper wall 11 and the lower wall 12 can be latching, screwing or a combination thereof, adjusted according to need. Through the arrangement of the upper partition board 61 and the lower partition board 62, air between the flow channel 4 and the housing 1 does not flow out to the external environment.

The flow channel 4 is joined to the inflow opening 14 of the modular cross flow fan. The flow channel 4 is elongated, and can have different lengths. The flow channel 4 can be integrally formed as one body or formed by assembly. After ambient air flows through the flow channel 4 and is heated or cooled by the heat exchanger 5, the hot or cold airflow is driven by the rotating cross flow fan 2 toward the outflow opening 15 and then outputted.

The heat exchanger 5 can be a heating device or a cooling device. In the present embodiment, the heat exchanger 5 is a heating device, but is not limited thereto in practice. The heating device produces heat, and can be a radiator, a plate heat exchanger, a ceramic heater, etc. The heat exchanger 5 is disposed in the flow channel 4 proximal to the inflow opening 14 of the modular cross flow fan. The heat exchanger 5 and the cross flow fan 2 are arranged in a line, such that after the ambient air passes through the heat device in the flow channel 4, the motor 3 drives the cross flow fan 2 to drive the hot airflow horizontally through the inflow opening 14 into the housing 1, and then through the rotation of the cross flow fan 2 the hot airflow is driven toward the outflow opening 15 and outputted to the room.

In summary of the above, the present disclosure provides a modular cross flow fan and an air conditioning device whose direction of inflow at the inflow opening and direction of outflow at the outflow opening are the same, falling horizontally in a 180 degrees line. The position and angle of the arrangement of the upper wall can be adjusted according to need. Thereby, the overall height and thickness of the present disclosure can be reduced, conducive to good product design.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A modular cross flow fan, comprising:

a housing having an upper wall, a lower wall and two side boards, wherein the upper wall, the lower wall and the two side boards define an accommodating space therebetween, the housing is formed with an inflow opening and an outflow opening, wherein the upper wall has a first board body, a second board body and a third board body, the first board body is connected between the second board body and the third board body, the third board is proximal to the side of the housing with the inflow opening, the second board body is proximal to the side of the housing with the outflow opening, the second board body and the third board body are parallel to each other and horizontal, the first board body is slanted, and the height of the first board body decreases in the direction from the inflow opening to the outflow opening;

the second board body defines an upper edge of the outflow opening, the third board body defines an upper edge of the inflow opening;

an inflow direction of the inflow opening is guided by the third board body, an outflow direction of the outflow opening is guided by the second board body respectively; so as to make the inflow direction of the inflow opening and the outflow direction of the outflow opening parallel to the second board body and the third board body respectively, and toward a same direction;

a cross flow fan disposed in the accommodating space; and a motor, disposed at the housing and connected to the cross flow fan.

2. The modular cross flow fan according to claim 1, wherein the two side boards are disposed at two opposite ends of the housing, the upper wall is connected to the upper ends of the two side boards, the lower wall is connected to the lower ends of the two side boards, and the upper ends of the two side boards and the lower ends of the two side boards have shapes corresponding respectively to the cross-sectional shapes of the upper wall and the lower wall.

3. The modular cross flow fan according to claim 1, wherein the inflow opening and the outflow opening are respectively formed on two opposite sides of the housing.

4. An air conditioning device, comprising:

a modular cross flow fan having a housing, a cross flow fan and a motor, wherein the housing has an upper wall, a lower wall and two side boards, the upper wall, the lower wall and the two side boards define an accommodating space therebetween, the housing is formed with an inflow opening and an outflow opening, wherein the upper wall has a first board body, a second board body and a third board body, the first board body is connected between the second board body and the third board body, the third board is proximal to the side of the housing with the inflow opening, the second board body is proximal to the side of the housing with the outflow opening, the second board body and the third board body are parallel to each other and horizontal, the first board body is slanted, and the height of the first board body decreases in the direction from the inflow opening to the outflow opening;

the second board body defines an upper edge of the outflow opening, the third board body defines an upper edge of the inflow opening;

an inflow direction of the inflow opening is guided by the third board body, an outflow direction of the outflow opening is guided by the second board body respectively, so as to make the inflow direction of the inflow opening and the outflow direction of the outflow opening parallel to the second board body and the third board body respectively, and toward a same direction, the cross flow fan is disposed in the accommodating space, and the motor is disposed at the housing and connected to the cross flow fan;

a flow channel joined to the inflow opening of the modular cross flow fan; and a heat exchanger disposed in the flow channel proximal to the inflow opening of the modular cross flow fan.

5. The air conditioning device according to claim 4, wherein the two side boards are disposed at two opposite ends of the housing, the upper wall is connected to the upper ends of the two side boards, the lower wall is connected to the lower ends of the two side boards, and the upper ends of the two side boards and the lower ends of the two side boards have shapes corresponding respectively to the cross-sectional shapes of the upper wall and the lower wall.

6. The air conditioning device according to claim 4, wherein a partition board is arranged between the housing and flow channel, the partition board has an upper partition board and a lower partition board, the upper partition board is connected to the flow channel and the side of the third board body proximal to the inflow opening, and the lower partition board is connected to the flow channel and the side of the lower wall proximal to the inflow opening.

7. The air conditioning device according to claim 4, wherein the cross flow fan and the heat exchanger lie in a line.

* * * * *